US012037879B2

(12) United States Patent
Dikshit et al.

(10) Patent No.: US 12,037,879 B2
(45) Date of Patent: Jul. 16, 2024

(54) MODULAR SCREENS FOR SAND CONTROL

(71) Applicant: Schlumberger Technology Corporation, Sugar Land, TX (US)

(72) Inventors: Ashutosh Dikshit, Houston, TX (US); Michael Plooy, Edmonton (CA); Seymur Gurbanov, Dubai (AE); Nikita Vikulin, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/004,218

(22) PCT Filed: Jun. 25, 2021

(86) PCT No.: PCT/US2021/039093
§ 371 (c)(1),
(2) Date: Jan. 4, 2023

(87) PCT Pub. No.: WO2022/010668
PCT Pub. Date: Jan. 13, 2022

(65) Prior Publication Data

US 2023/0279749 A1 Sep. 7, 2023

Related U.S. Application Data

(60) Provisional application No. 63/048,186, filed on Jul. 5, 2020.

(51) Int. Cl.

| | |
|---|---|
| ***E21B 43/08*** | (2006.01) |
| ***E21B 17/10*** | (2006.01) |
| ***E21B 34/14*** | (2006.01) |

(52) U.S. Cl.
CPC ..... *E21B 43/08* (2013.01); *E21B 17/1078* (2013.01); *E21B 34/14* (2013.01); *E21B 2200/06* (2020.05)

(58) Field of Classification Search
CPC ..... E21B 17/1078; E21B 43/08; E21B 34/14; E21B 2200/06
See application file for complete search history.

(56) References Cited

U.S. PATENT DOCUMENTS

| | | | |
|---|---|---|---|
| 8,807,215 | B2 | 8/2014 | Holderman |
| 9,670,756 | B2 | 6/2017 | Yeh |

(Continued)

FOREIGN PATENT DOCUMENTS

| | | | |
|---|---|---|---|
| EP | 2570586 | A1 | 3/2013 |
| WO | 2022047281 | A1 | 3/2022 |

OTHER PUBLICATIONS

International Search Report and Written Opinion issued in PCT Application PCT/US2021/039093, dated Oct. 18, 2021 (13 pages).

*Primary Examiner* — Yong-Suk (Philip) Ro
(74) *Attorney, Agent, or Firm* — Jeffrey D. Frantz

(57) ABSTRACT

A technique facilitates production of desired well fluids. A well string may comprise a plurality of well screen joints which are assembled for receipt of a well fluid from a desired well zone along a wellbore. The well screen joints are constructed and assembled in a manner which also creates a flow path to a common inflow area. At this common inflow area, the well fluid may be directed through a port or ports into an interior production passage of the well string for production to a desired collection area. The port or ports at the common inflow area may be selectively closed to block inflow of fluid from the plurality of well screen joints.

16 Claims, 7 Drawing Sheets

(56) References Cited

U.S. PATENT DOCUMENTS

| | | | | |
|---|---|---|---|---|
| 10,364,656 | B2 | 7/2019 | Greci | |
| 2017/0002625 | A1* | 1/2017 | Chochua | E21B 43/12 |
| 2017/0058647 | A1 | 3/2017 | Langlais | |

* cited by examiner

MODULAR SCREENS FOR SAND CONTROL

CROSS-REFERENCE TO RELATED APPLICATION

The present document is a National Stage of International Application No. PCT/US2021/039093, filed Jun. 25, 2021, based on and claims priority to U.S. Provisional Application Ser. No. 63/048,186, filed Jul. 5, 2020, which is incorporated herein by reference in its entirety.

BACKGROUND

In many oil and gas well applications, a borehole is drilled into the earth and subsequently completed with equipment, i.e. completion equipment, to facilitate production of desired fluids from a reservoir. The completion equipment may comprise various types of sand control equipment, e.g. sand filter screens, which block the inflow of sand as the oil and/or gas flow into the completion equipment. The completion equipment may be assembled by connecting sand screen joints and deploying the sand screen joints downhole into the wellbore to a desired well zone. In a variety of applications, the wellbore may comprise multiple well zones and several sand screen joints may be disposed along each of the well zones. Within each well zone, the individual sand screen joints may comprise inflow ports through which the well fluid flows into the interior of the completion equipment for production to the surface. The individual sand screen joints also may be fitted with sliding sleeves or other devices enabling closure of the inflow ports to prevent, for example, the unwanted influx of water or other undesirable fluids. However, closure of ports along multiple sand screen joints in a given well zone can be time-consuming and expensive.

SUMMARY

In general, a system and methodology are provided for facilitating production of desired well fluids. According to an embodiment, a well string comprises a plurality of well screen joints. The well screen joints are able to receive a well fluid from a desired well zone along a wellbore while filtering out unwanted sand. Additionally, the well screen joints are constructed to cooperate in providing a flow path to deliver the well fluid to a common inflow area. At this common inflow area, the well fluid is directed through a port or ports into an interior production passage of the well string for production to a desired collection area. According to some embodiments, the port or ports at the common inflow area may be selectively closed to block inflow of unwanted fluid from the plurality of well screen joints.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
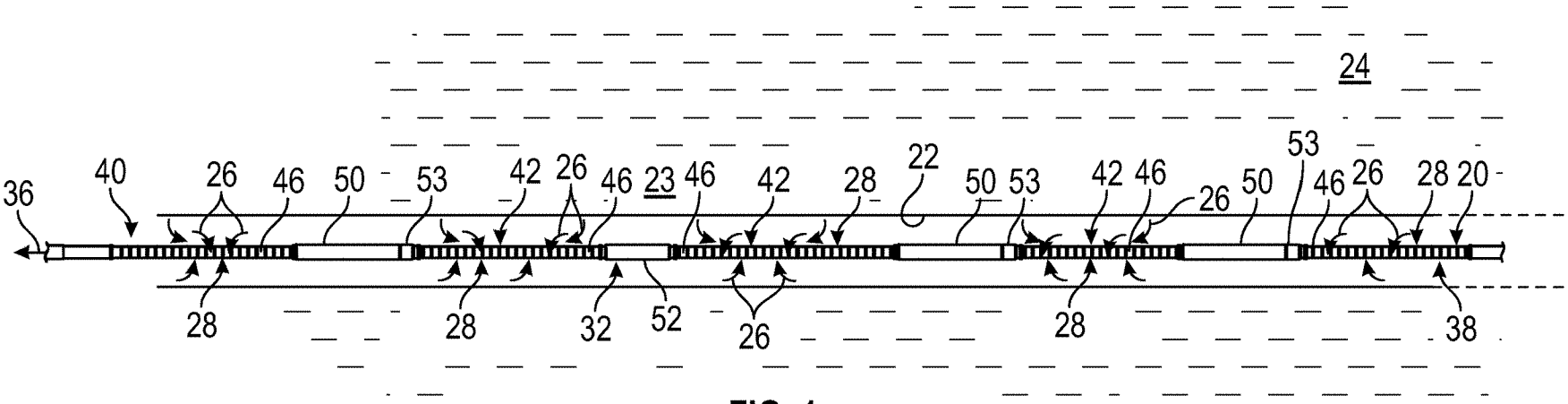
FIG. 1 is an illustration of an example of a well string comprising a plurality of well screen joints which deliver inflowing fluid to a common inflow area, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible. This description is not to be taken in a limiting sense, but rather for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

The disclosure herein generally involves a system and methodology for facilitating production of desired well fluids. According to an embodiment, a well string comprises a plurality of well screen joints. The well screen joints are assembled for receipt of a well fluid from a desired well zone along a wellbore while providing sand control. The well screen joints are constructed and assembled in a manner which also creates a flow path to a common inflow area. At this common inflow area, the well fluid is directed through a port or ports into an interior production passage of the well string for production to a desired collection area. According to some embodiments, the port or ports at the common inflow area may be selectively closed to block inflow of fluid from the plurality of well screen joints. In this manner, a plurality of well screen joints may be used along a given well zone while control over the inflow of well fluid from the given well zone to the interior of the well string may be allowed or blocked via shifting of a single mechanism, e.g. a single sleeve.

Depending on the parameters of a given application, the plurality of sand control well screen joints may comprise a top screen joint, a bottom screen joint, and one or more intermediate screen joints which received well fluid and direct the well fluid along a flow path to the common inflow area. In some embodiments, the common inflow area may be defined by a sliding sleeve device having at least one port, e.g. 1-6 ports, through which fluid from the plurality of sand control well screen joints flows to an internal production passage for production to a desired collection location, e.g. a surface collection location. The sliding sleeve device may comprise a sliding sleeve which may be selectively moved between open flow and closed flow positions with respect to the at least one port. By shifting the sliding sleeve to the closed flow position, for example, inflow from the plurality of sand control well screen joints may be stopped. The use of this single device to block inflow of fluid simplifies the process of preventing inflow of unwanted fluid, e.g. water, from a given well zone.

According to an operational embodiment, a bottom well screen joint is run in hole. With a box end of the bottom well screen joint on a screen table, a subsequent well screen joint may be made up to it by, for example, threading the pin end of the subsequent well screen joint into the suspended box end. After forming the joint coupling, the combined well screen joints may be released and a slidable shroud may be slid down into place over the joint coupling. The slidable shroud is constructed to form a portion of the flow path past the joint coupling so the desirable inflowing well fluid is able to move to the common inflow area. By way of example, the slidable shroud may be initially held in position by setscrews or other suitable coupling mechanism and then sequentially secured in position over the joint coupling via setscrews or other suitable coupling mechanism.

This process can be repeated for each sequential well screen joint and/or other well string components such as the sliding sleeve device. It should be noted the sliding sleeve device may be constructed as a standalone assembly, as part of a modular screen joint, or as part of another component of the overall well string. Ultimately, a top well screen joint is made up into the plurality of well screen joints assembled for a given well zone. It should be noted this overall assembly utilizes the established flow path to conduct the inflowing well fluid to the common inflow area defined by the sliding sleeve device or other suitable device so that inflow from a plurality of well screen joints may be combined and directed to an internal production passage of the well string via this one common inflow area. This type of assembly of well string joints may be repeated along the well string for additional well zones.

Additionally, the techniques for joining of well string joints, shrouds, and other components used to create the flow path to the common inflow area may be selected simply to provide sand control. In other words, the joining of components is sufficient if able to block the influx of sand without necessarily being sealed against the inflow of fluid.

Referring generally to FIG. 1, an example of a well string 20 is illustrated as deployed in a wellbore 22 along a given well zone 23. In this example, the wellbore 22 has been drilled into a surrounding formation 24 containing a desired fluid or fluids 26 (see arrows 26) which are able to flow into the wellbore 22 and ultimately into the well string 20. As described in greater detail below, the fluid 26 flows into a plurality of well screen joints 28 and is directed along a flow path 30 (see also FIG. 2) to a common inflow area 32 before being directed to an internal flow passage 34 of the well string 20 (see also FIG. 2). Once the fluid 26 enters the internal flow passage 34 of well string 20, it may be produced along the internal flow passage 34, as indicated by arrow 36, to a desired collection location.

In the embodiment illustrated in FIG. 1, the plurality of well screen joints 28 of well string 20 includes, for example, a lower well screen joint 38 positioned downhole of the common inflow area 32 and an upper well screen joint 40 positioned uphole of the common inflow area 32. The lower well screen joint 38 and the upper well screen joint 40 establish the outlying portions of flow path 30 and are open to flow of fluid toward common inflow area 32 while being closed to flow away from the common inflow area 32. At least one intermediate well screen joint 42, e.g. a plurality of intermediate well screen joints 42, may be located between the lower well screen joint 38 and the upper well screen joint 40. The well screen joints 28 are sequentially connected to effectively provide a modular screen assembly that may be assembled in a variety of lengths for providing sand control. With additional reference to FIG. 2, each of the well screen joints 28 may comprise a base pipe 44 surrounded at least in part by a filter screen 46. The filter screens 46 may be constructed from a variety of materials and in various desired configurations, such as wire mesh configuration, direct wrap configuration, or other configuration suitable to filter out sand from the inflowing well fluid 26.

The various components of well string 20, e.g. well screen joints 28, may be sequentially connected by suitable joint couplings 48. By way of example, the joint couplings 48 may be in the form of conventional box end and pin end couplings which are made up via threaded engagement while supported on a screen table before being deployed downhole. Once made up, i.e. connected together, each joint coupling 48 may be enclosed by a shroud 50, e.g. a slidable shroud which is slid axially over the corresponding joint coupling 48 in a manner which continues the flow path 30 past the corresponding joint coupling 48.

Figure 2:
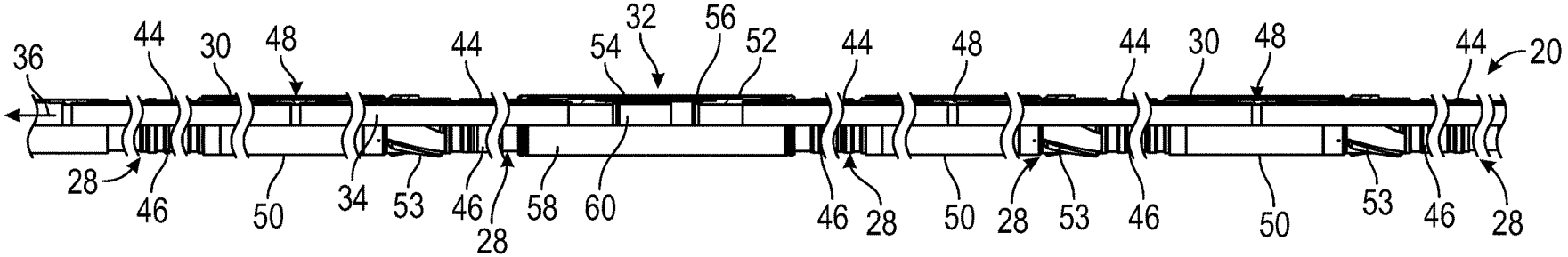
FIG. 2 is an enlarged, partially cut away view of the well string illustrated in FIG. 1, according to an embodiment of the disclosure.

In the embodiment illustrated, the common inflow area 32 is established by a sliding sleeve device 52 having at least one port 54, e.g. 1-6 ports, located through a device housing 56 to enable flow of the well fluid 26 from the flow path 30 to the internal production passage 34 of well string 20. As illustrated, the sliding sleeve device 52 may comprise an outer device shroud 58 surrounding housing 56 and located so as to form and direct the flow path 30 to the port(s) 54. The sliding sleeve device 52 also may comprise an internal sliding sleeve 60 slidably mounted along the interior of housing 56 and shiftable between positions allowing flow or blocking flow through the port(s) 54. In FIG. 2, the sliding sleeve 60 is positioned at a flow blocking location.

It should be noted the sliding sleeve device 52 may be constructed as a separate component, e.g. as a separate well string joint. However, the sliding sleeve device 52 also may be combined with other components such as filter screens and/or other well string components which may be utilized in a given operation. In the embodiment illustrated in FIG. 2, for example, the adjacent filter screens 46 illustrated immediately uphole and downhole may be formed as part of the sliding sleeve device 52 or as separate well screen joints 28. In some embodiments, the well string 20 also comprises a plurality of centralizers 53, e.g. spiral centralizers or other suitable centralizers, which help centralize the well string 20 within wellbore 22.

Figure 3:
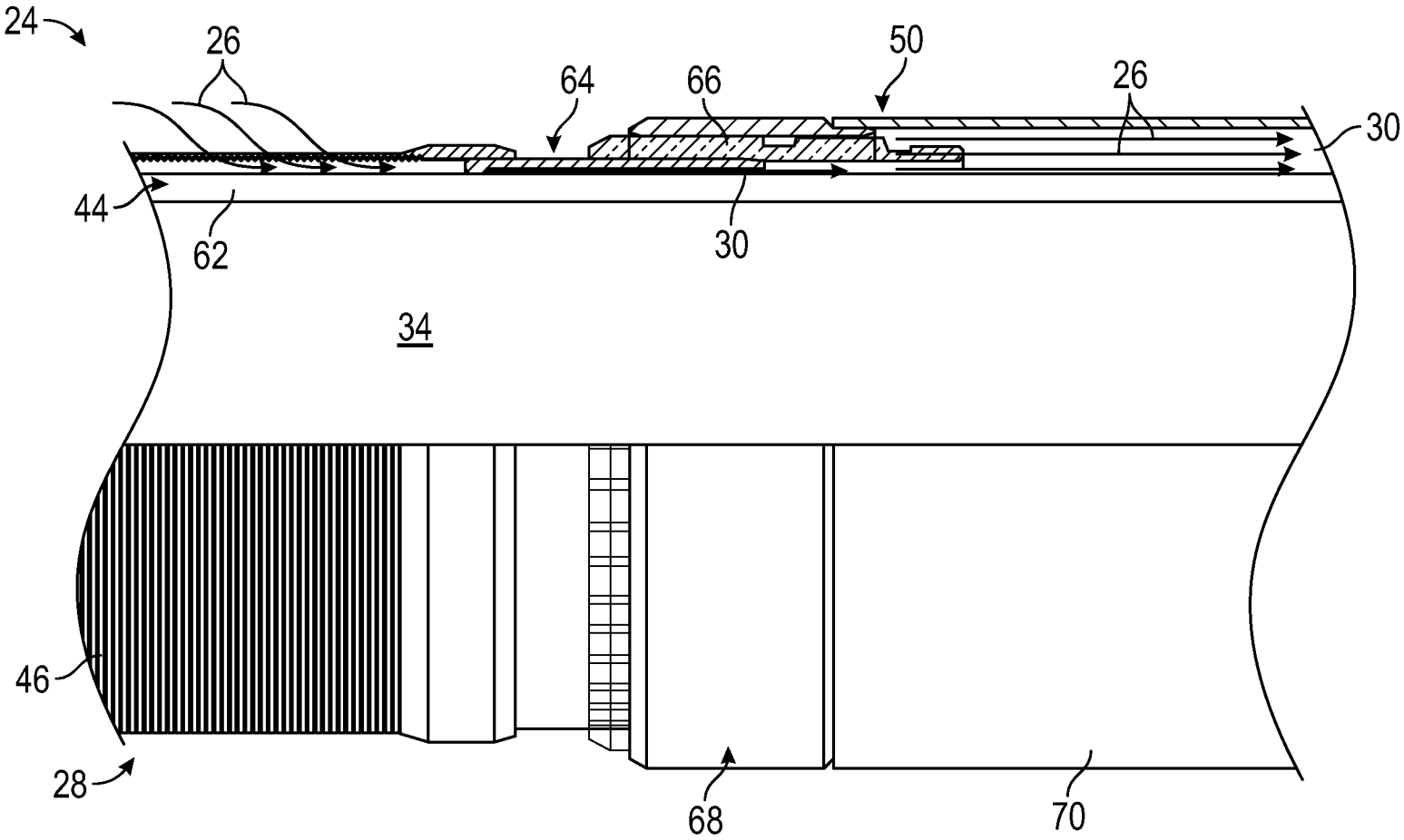
FIG. 3 is a partially cut away view of a portion of the well string illustrated in FIG. 2, according to an embodiment of the disclosure.

Referring generally to FIG. 3, an enlarged portion of the well string 20 is illustrated to provide an example of the various well string joints 28 which may be constructed so as to create flow path 30 along the exterior of the base pipe(s) 44. In this example, the illustrated well string joint 28 is the upper well string joint 40. Well fluid 26 flows from formation 24, into wellbore 22, through the filter screen 46, and into flow path 30 between the filter screen 46 and the base pipe 44. The illustrated base pipe 44 is a solid base pipe in that it is formed with a base pipe wall 62 having no lateral ports therethrough. Accordingly, the fluid 26 is maintained along the exterior of the base pipe 44 as it flows along flow path 30.

The flow of fluid 26 along flow path 30 continues from filter screen 46 and moves along a passage or passages formed between base pipe 44 and a bypass ring 64. The bypass ring 64 is connected between filter screen 46 and a shroud support structure 66 which slidably supports shroud 50. In the example illustrated, the shroud 50 comprises an outer end ring 68 which is welded or otherwise secured to a shroud body 70. The flow of fluid 26, as indicated by flow arrows, continues along flow path 30 between the support structure 66 and base pipe 44 and then along the passage or passages formed between shroud 50 and base pipe 34.

Figure 4:
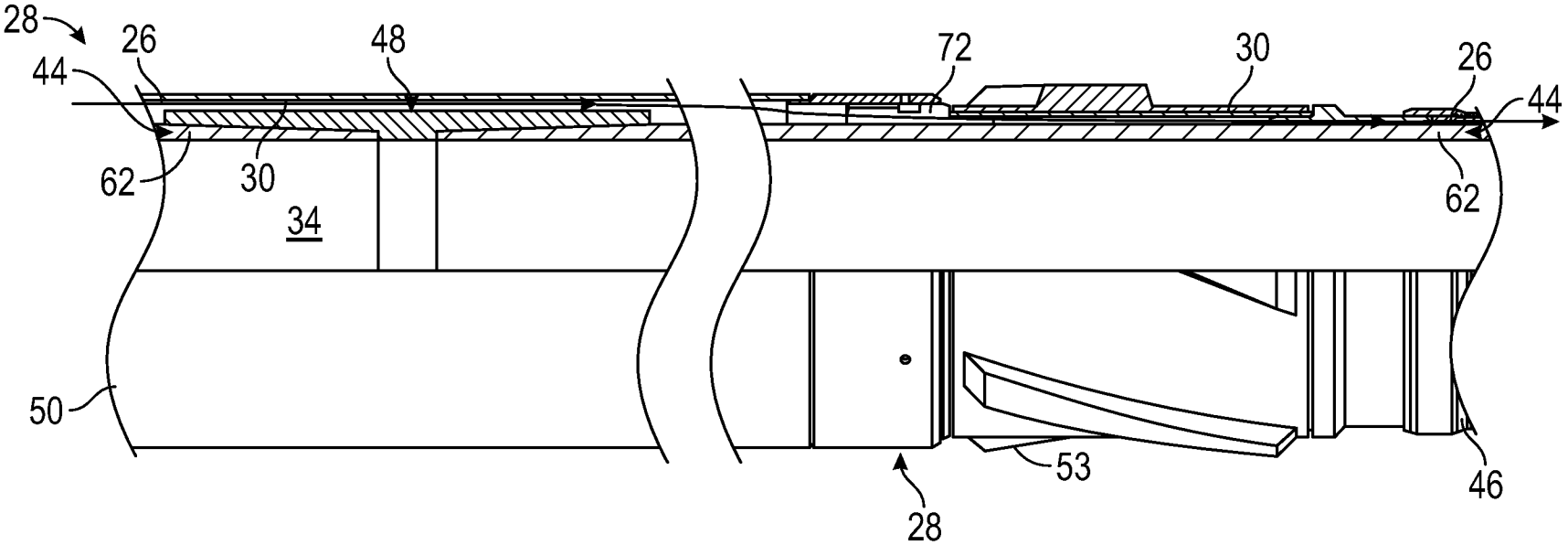
FIG. 4 is a partially cut away view of another portion of the well string illustrated in FIG. 2, according to an embodiment of the disclosure.

As further illustrated in FIG. 4, the flow of fluid 26 continues along path 30 beneath shroud 50 and crosses along the exterior of joint coupling 48 beneath shroud 50. In this example, the flow path 30 continues beneath a second shroud support structure 72 and then between the illustrated centralizer 53 and the next sequential base pipe 44. After exiting the centralizer 53, the fluid 26 flows along flow path 30 to the passage or passages between the next sequential filter screen 46 and the corresponding base pipe 44. In this area, additional fluid 26 may enter the flow path 30 through this next sequential filter screen 46 to form a combined flow of fluid 26 moving toward the common inflow area 32, e.g. ports 54 of sliding sleeve device 52.

Figure 5:
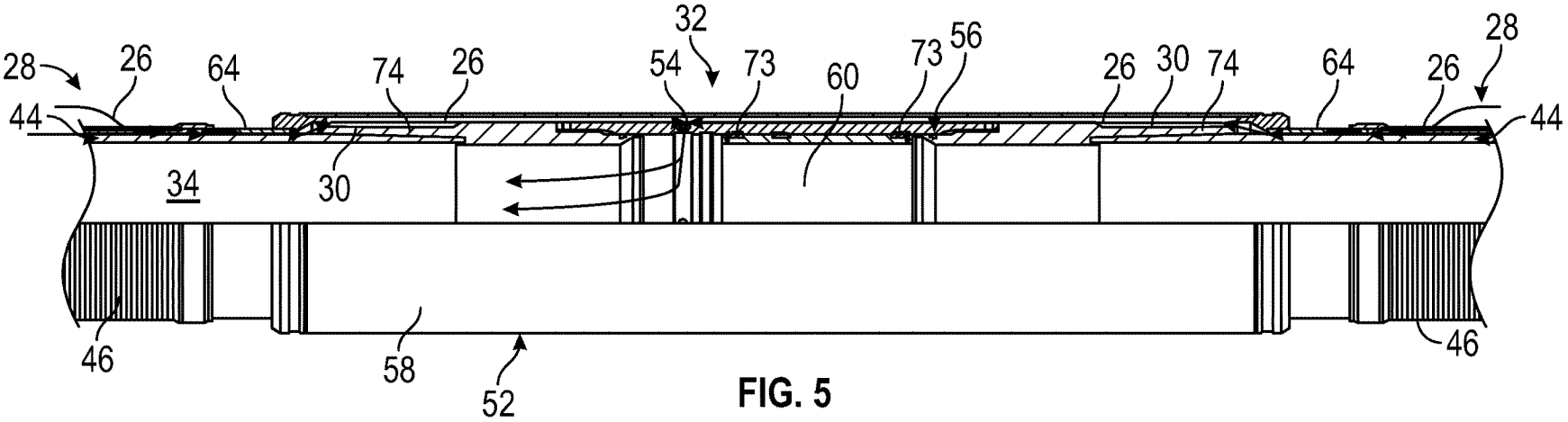
FIG. 5 is a partially cut away view of another portion of the well string illustrated in FIG. 2 and including an example of a sliding sleeve device at the common inflow area, according to an embodiment of the disclosure.
Figure 6:
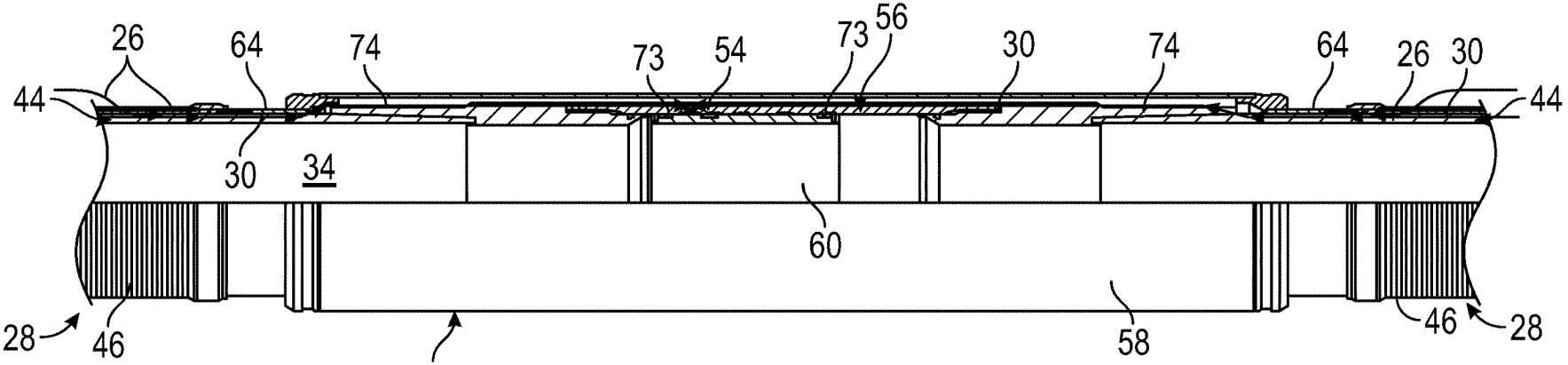
FIG. 6 is a partially cut away view similar to that illustrated in FIG. 5 but showing the sliding sleeve device in a different operational position, according to an embodiment of the disclosure.

Referring generally to FIGS. 5 and 6, an embodiment of sliding sleeve device 52 is illustrated. In this example, sliding sleeve device 52 comprises device housing 56 which as an interior forming a portion of the internal flow passage 34. The device housing 56 also includes the port or ports 54 extending laterally therethrough. The internal sliding sleeve 60 may be shifted between open flow (see FIG. 5) and closed flow (see FIG. 6) positions which allow flow of fluid 26 into internal flow passage 34 or block flow of fluid 26 into internal flow passage 34, respectively. Sliding sleeve 60 may utilize seals 73 arranged to seal off flow through port(s) 54 when in the closed position. The device housing 56 may be formed as a unitary structure or from a plurality of components threadably or otherwise secured together as illustrated. Each end of the device housing 56 may comprise an appropriate coupling mechanism 74, e.g. a threaded coupling mechanism, to which adjacent well screen joints may be made up, i.e. connected. The outer shroud 58 is positioned about the device housing 56 to establish and continue the flow path 30 to the port(s) 54 from both an uphole direction and a downhole direction.

As illustrated, the fluid 26 received from both uphole and downhole filter screens 46 flows along the flow path 30 between the corresponding base pipes 44 and additional bypass rings 64. The fluid 26 then flows into the portion of flow path 30 located between device housing 56 and outer shroud 58 of sliding sleeve device 52 and continues to flow to the port(s) 54 when sliding sleeve 60 is in the open flow position as illustrated in FIG. 5. The port(s) 54 allow the flowing fluid 26 to move into the internal flow passage 34 for production to a desired collection location as described above.

Based on the construction of the well screen joints 28 and sliding sleeve device 52, the flow path 30 is maintained external to the base pipes 44 until the fluid 26 is able to enter internal flow passage 34 via port(s) 54. As a result, the inflow of fluid from a plurality of well screen joints 28 may be blocked at the single common inflow area 32 via, for example, shifting the single sliding sleeve 60. If, for example, unwanted water influx or gas influx occurs in this particular well zone 23, the inflow of fluid may be blocked simply by actuating a single device, e.g. shifting the single sleeve 60, which blocks inflow from a plurality of well screen joints 28 disposed along the well zone 23. Shifting of sliding sleeve 60 may be achieved relatively quickly and inexpensively by, for example, running a shifting tool downhole to engage the sliding sleeve 60 and to shift it in a linear direction to the desired operational position.

Figure 7:
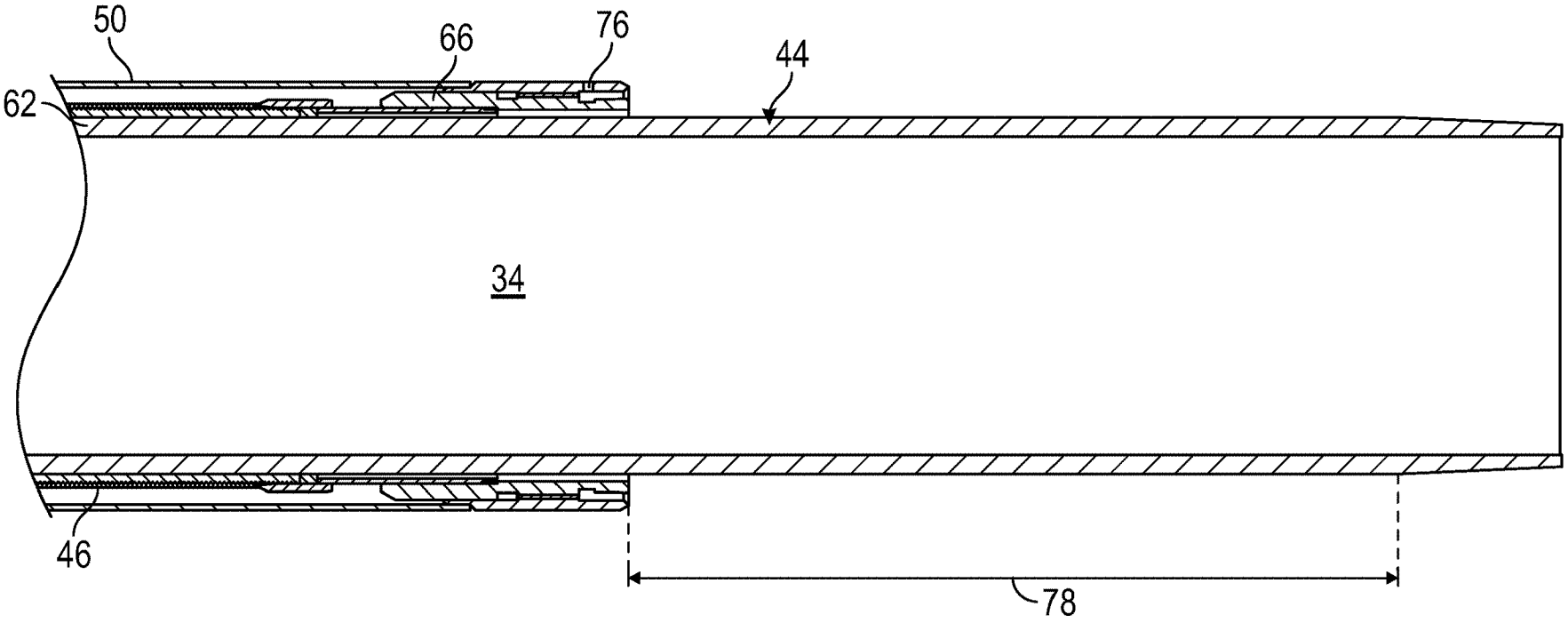
FIG. 7 is a cross-sectional view of a portion of the well string having an example of a slidable shroud used to form a portion of the flow path to the common inflow area, according to an embodiment of the disclosure.
Figure 8:
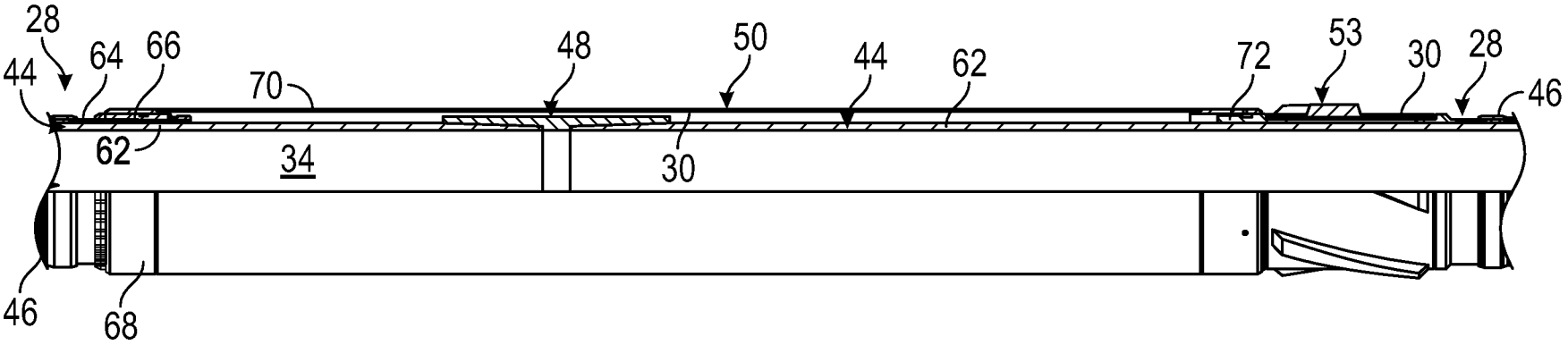
FIG. 8 is a partially cut away view of the slidable shroud slid to a closed position, thus completing a portion of the flow path across a joint coupling, according to an embodiment of the disclosure.

Referring generally to FIGS. 7 and 8, an example of one type of slidable shroud 50 is illustrated. In this embodiment, the shroud 50 is initially slid back over shroud support structure 66 to a position surrounding, for example, the corresponding filter screen 46, as illustrated in FIG. 7. The shroud 50 may be held in this position by a suitable retention mechanism 76, e.g. set screws securing the shroud 50 to the support structure 66.

In this retracted position, an end section 78 of the base pipe 44 is exposed to provide access to the base pipe 44 during a makeup operation at the rig as sequential sections of the well string 20 are connected to each other via joint coupling 48. Following makeup of the joint coupling 48, the well string 20 may be shifted in a downhole direction and the retention mechanism 76 may be released so that the shroud 50 may be slid linearly over the joint coupling 48 and into engagement with the second shroud support structure 72, as illustrated in FIG. 8. The set screws or other suitable retention mechanism 76 may then be used to secure the shroud 50 in place over the joint coupling 48. For example, setscrews/retention mechanism 76 may be used to secure the shroud 50 to the second shroud support structure 72.

It should be noted that fluid tight seals may be used between the shroud 50 and the support structures 66, 72, as well as between other component connections forming flow path 30. However, in a variety of applications such connections do not require fluid tight seals and may be simply constructed as metal-to-metal connections or other connection suitable to provide sand control by preventing the influx of sand into flow path 30.

Figure 9:
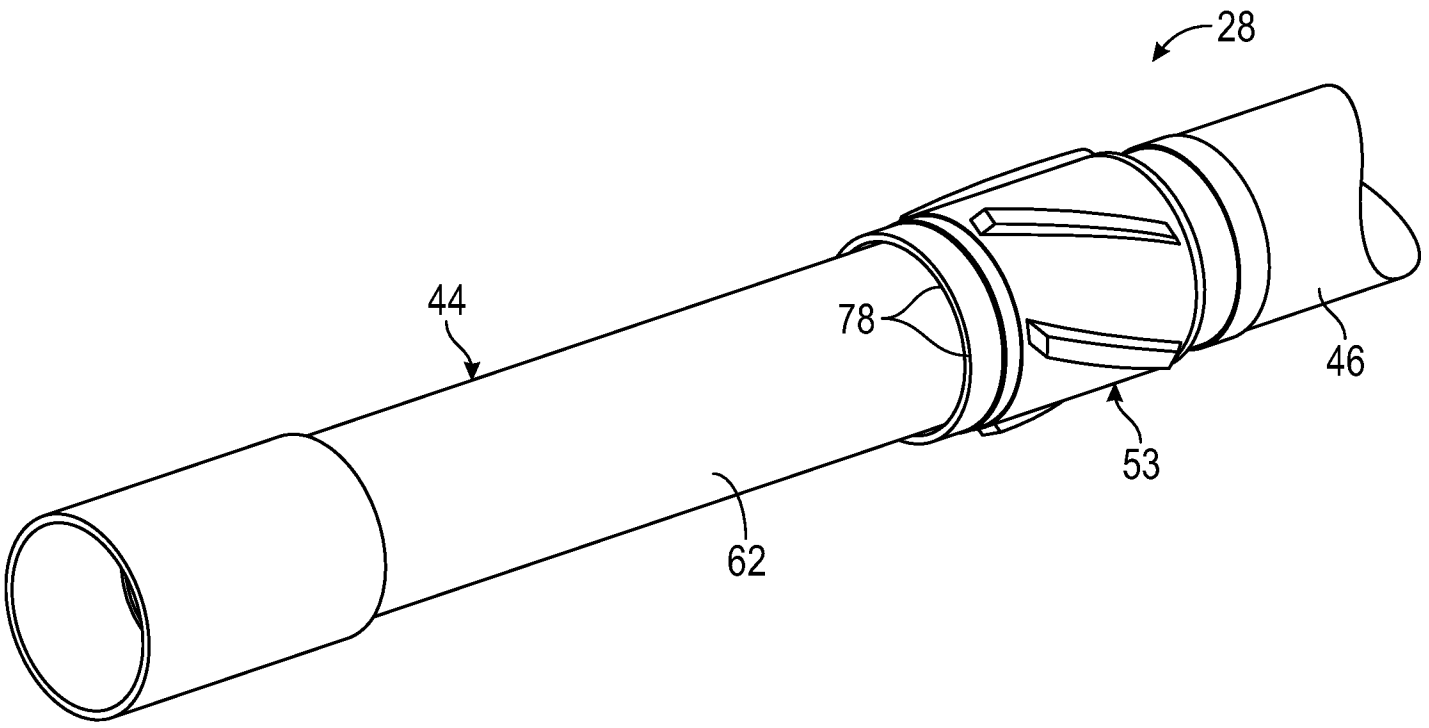
FIG. 9 is an illustration of an example of a centralizer which may be positioned along the well string to facilitate centralization of the well string in a corresponding borehole, e.g. wellbore, according to an embodiment of the disclosure.

In FIG. 9, an example of one of the base pipes 44 is illustrated as extending into a corresponding centralizer 53. As illustrated, this base pipe 44 (as well as the other base pipes 44 in a given well zone 23) is formed with the solid base pipe wall 62, thus preventing flow of fluid 26 to the internal production passage 34 as it travels along the exterior of the base pipe 44. As a result, the fluid 26 is forced to flow along the flow path 30 externally of production passage 34 until the fluid 26 is allowed to enter via the one or more ports 54. The flow path 30 may be defined by the components of well string 20 via various configurations of features, e.g. longitudinal channels 78 extending beneath the centralizer 53. Such longitudinal channels 78 or other annular spaces or features may be used to accommodate the flow of fluid 26 as it enters the well string 20 via filter screens 46 and moves in the appropriate directions towards port(s) 54.

Depending on the parameters of a given operation and the environment in which such operation is conducted, the number of filter screens 46 and well screen joints 28 associated with a given common inflow area 32 may vary substantially. For example, two filter screens 46, three filter screens 46, or multiple filter screens 46, e.g. at least 10 filter screens, may be associated with the single common inflow area 32/single sliding sleeve device 52 for the given well zone 23. The arrangement of well screen joints 28 and sliding sleeve device 52 may be repeated along the well string 20 for different well zones 23 disposed along the overall wellbore 22.

Furthermore, additional or other components may be incorporated into the well string 20 according to the parameters of a given operation. The size and configuration of various components also may be adjusted according to the specific operation. For example, the sliding sleeve device 52 may comprise a variety of sliding sleeves 60 which may be manipulated by downhole actuators, by running a shifting tool downhole, or by other suitable mechanisms. Additionally, other types of actuatable devices may be used to allow or block flow through the port(s) 54 at the common inflow area 32. In some embodiments, the shroud 50 may be formed from solid sheet-metal. However, other applications may utilize shrouds 50 with slots or other types of holes able to provide pressure balancing while preventing the influx of sand. The shrouds 50, device housing 56, and other components may be made as unitary components or as combinations of separate subcomponents. Various connections may be formed by threaded engagement, welding, or other suitable coupling techniques.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string comprising:

a sliding sleeve device comprising:

a shroud comprising a shroud inner surface;

a housing comprising:

a housing outer surface, wherein the housing outer surface and the shroud inner surface define a first annulus extending radially therebetween;

a housing inner surface defining an interior flow passage; and at least one port extending from the housing outer surface to the housing inner surface; and a sleeve disposed within the housing, the sleeve being slidable between a first position and a second position, wherein in the first position, the first annulus and the interior flow passage are in fluid communication through the at least one port, and wherein in the second position, fluid communication between the first annulus and the interior flow passage is blocked;

a first well screen joint comprising a first screen disposed about a first base pipe, wherein the first well screen joint is coupled to a first end of the sliding sleeve device, and wherein a second annulus disposed between the first base pipe and the first screen is in fluid communication with the interior flow passage of the sliding sleeve device when the sleeve is in the first position; and a second well screen joint comprising a second screen disposed about a second base pipe, wherein the second well screen joint is coupled to a second end of the sliding sleeve device, and wherein a third annulus disposed between the second base pipe and the second screen is in fluid communication with the interior flow passage of the sliding sleeve device when the sleeve is in the first position.

2. The system as recited in claim 1, wherein the well string further comprises a joint shroud is disposed around an end of the first well screen joint opposite the sliding sleeve device.

3. The system as recited in claim 2, wherein the joint shroud forms a flow path in communication with the first annulus.

4. The system as recited in claim 1, wherein the well string further comprises a plurality of centralizers.

5. The system as recited in claim 4, wherein the plurality of centralizers are spiral centralizers.

6. The system as recited in claim 4, wherein each centralizer forms a flow passage in fluid communication with the first annulus.

7. The system of claim 1, wherein the well string further comprises a third well screen joint coupled to an end of the first well screen joint opposite the sliding sleeve device, the third well screen joint comprising:

a third screen disposed about a third base pipe; and a fourth annulus extending between the third base pipe, wherein the fourth annulus is in fluid communication with the interior flow passage when the sleeve is in the first position.

8. A system, comprising:

a well string comprising:

a first well screen joint comprising a first screen disposed about a first base pipe, wherein a first annulus extends radially between the first well screen and the first base pipe;

a second well screen joint comprising a second screen disposed about a second base pipe, wherein a second annulus extends radially between the second screen and the second base pipe; and a common inflow device comprising:

a shroud;

a housing disposed within the shroud and comprising at least one port and an interior flow passage;

a first end coupled to the first well screen joint; and a second end coupled to the second well screen joint, wherein:

a third annulus extends radially between the shroud and the housing;

the first annulus and the third annulus are in fluid communication;

the second annulus and the third annulus are in fluid communication; and the first annulus, second annulus, and third annulus are in fluid communication with the interior flow passage through the at least one port, and the at least one port is selectively opened or closed to flow therethrough.

9. The system as recited in claim 8, wherein the common inflow device comprises a sliding sleeve disposed within the housing, the sliding sleeve being slidable between a first position and a second position, and wherein:

in the first position, the first annulus and the interior flow passage are in fluid communication through the at least one port, and in the second position, fluid communication between the first annulus and the interior flow passage is blocked.

10. The system as recited in claim 8, wherein the well string further comprises a plurality of centralizers.

11. The system as recited in claim 10, wherein each centralizer of the plurality of centralizers forms a flow path in fluid communication with the first annulus.

12. The system as recited in claim 8, wherein the first well screen joint is located uphole of the common inflow device and the second well screen joint is located downhole of the common inflow device.

13. The system of claim 8, wherein the well string further comprises a third well screen joint coupled to an end of the first well screen joint opposite the common inflow device, the third well screen joint comprising:

a third screen disposed about a third base pipe; and a fourth annulus extending between the third base pipe, wherein the fourth annulus is in fluid communication with the interior flow passage through the at least one port.

14. A method, comprising:

shifting a sliding sleeve of a common inflow device in a wellbore from a closed position to an open position, the common inflow device disposed between a first well screen joint and a second well screen joint, wherein:

in the closed position, fluid communication between an interior flow path of the common inflow device and a first annular flow path of the common inflow device through one or more ports is blocked; and in the open position, fluid communication is allowed between the first annular flow path of the common inflow device through the one more ports; and flowing a well fluid along the interior flow path to a desired collection location, wherein a first portion of the well fluid flows through a second annular flow path of the first well screen joint into the interior flow path through the one or more ports, and wherein a second portion of the well fluid flows through a third annular flow path of the second well screen joint into the interior flow path through the one or more ports.

15. The method of claim 14, further comprising running a shifting tool into the wellbore, wherein the shifting tool is configured to shift the sliding sleeve from the closed position to the open position.

16. The method of claim 14, wherein a third well screen joint is coupled to an end of the first well screen joint opposite the common inflow device, and wherein a third portion of the well fluid flows through a fourth annular flow path of the third well screen joint into the interior flow path through the one or more ports.

* * * * *